US005987797A

United States Patent [19]

Dustin

[11] Patent Number: 5,987,797

[45] Date of Patent: Nov. 23, 1999

[54] FIREARM WITH INTERCHANGEABLE BARRELS

[76] Inventor: John Dustin, 29 Pinehurst La., Half Moon Bay, Calif. 94019

[21] Appl. No.: 09/148,412

[22] Filed: Sep. 4, 1998

[51] Int. Cl.[6] ..... F41A 21/00

[52] U.S. Cl. ..... 42/75.02

[58] Field of Search ..... 42/75.02, 77

[56] References Cited

U.S. PATENT DOCUMENTS

| | | | |
|---|---|---|---|
| 1,517,328 | 12/1924 | Weiss | 42/77 |
| 2,795,881 | 6/1957 | Bellows | 42/75 |
| 3,138,889 | 6/1964 | Groover | 42/77 |
| 3,731,418 | 5/1973 | Birkenhagen et al. | 42/75 B |
| 3,805,434 | 4/1974 | Sudano | 42/77 |
| 3,842,527 | 10/1974 | Low | 42/75 B |
| 3,877,167 | 4/1975 | Keppeler | 42/75 B |
| 4,288,938 | 9/1981 | Kahn | 42/59 |
| 4,297,801 | 11/1981 | Kahn | 42/59 |
| 4,674,217 | 6/1987 | Matievich | 42/76.01 |
| 5,020,260 | 6/1991 | Houghton | 42/75.02 |
| 5,410,834 | 5/1995 | Benton et al. | 42/75.02 |

*Primary Examiner*—Charles T. Jordan
*Assistant Examiner*—Jeffrey Howell
*Attorney, Agent, or Firm*—Michael Hetherington

[57] ABSTRACT

We disclose a new switch-barrel system for firearms, particularly centerfire rifles, which permits the ready exchangeability of barrels upon a single action/stock assembly. Barrels may be quickly and easily exchanged under field conditions using a minimum of simple, lightweight equipment, without removing the action from the stock. Barrels of many different weights and calibers may be used on a single firearm, leading to great versatility. Barrels are free-floating in a manner similar to most benchrest rifles, ensuring uniform barrel harmonics upon firing. The system relies on a secondary set of fine-pitched threads and a locking ring to effect the securing of the barrel to the action, which acts to repeatably draw all barrels into invariable coaxial alignment with the action, thus insuring a return to essentially the same point of impact. The system is adaptable to a broad range of existing firearms, and does not require a proprietary action. It does not significantly alter the lines of fine sporting arms, and adds only a minimum of bulk. It does not require hardened setscrews or other securing devices which can easily mar barrel steel. It permits firearms to be broken down for transport in more compact containers, and is self-correcting for wear in the securing and headspacing relationships.

8 Claims, 3 Drawing Sheets

FIREARM WITH INTERCHANGEABLE BARRELS

BACKGROUND

The field of the invention relates in general to firearms and more particularly, to a firearm for readily accepting a wide variety of interchangeable barrels.

Existing firearm designs which provide for a single action and stock to accept a variety of different barrels suffer from a number of deficiencies and impracticalities which render them generally undesirable to consumers and users. Among such deficiencies and impracticalities are the following.

In certain existing switch-barrel rifles, methods of barrel attachment unduly reduce the dimensions and weaken the barrel in the chamber area, thereby limiting the range of useable cartridges and increasing the likelihood of extraction difficulties and problems in the reloading of fired cartridges.

Some existing switch barrel methods of attachment also do not provide for repeatable installation. Also, conventional methods for providing interchangeable barrels do not fully secure the barrel in the action, thus severely compromising disposed accuracy. For example, U.S. Pat. No. 3,842,527 relies upon a set screw through the receiver ring which engages the barrel threads to prevent rotation. There are significant problems with this approach.

In order to assure proper machinability and smooth interior finish, virtually all commercially available barrels are made from relatively unhardened steel, with Rockwell "C" hardness ranges in the high 20's and low 30's. In contrast, set screws, because of the very nature of the work they do, are always hardened to a much greater degree. Thus, a set screw such as the one used in U.S. Pat. No. 3,842,527 must be screwed in against the soft barrel threads and will deform those threads quite easily, leading to difficulty in removing the barrel and other operational problems.

Another disadvantage of conventional methods for securing a barrel to an action in switch-barrel rifles is that there must be some clearance between the threads of the female action and the male barrel threads, or it will be impossible to screw the action and barrel together. A conventional side engaging set screw will always thrust the installed barrel to the other side, opposite the set screw to some degree. This results in a barrel which will not always be in uniform coaxial alignment with the action. Virtually all barrel threads are less than one inch in length, and many are three-quarter inch or less. A side deflection of only 0.001 inches in a span of 0.750 inches will produce a point of impact deflection of 4.8 inches at 100 yards. Such a conventional method for attaching a barrel produces an utterly unsatisfactory situation from an accuracy standpoint.

Other existing methods of barrel attachment may unduly reduce the size and weaken the barrel in the chamber area, thereby limiting the range of useable cartridges and increasing the likelihood of extraction difficulties and problems in the reloading of fired cartridges. Such conventional methods of barrel attachment are also conducive to damage and deformation of the barrel. For example, many conventional sporting rifles have a muzzle diameter of no more than 0.550 inches. This means that male hexagonal wrenches used to disengage such barrels under this scheme are, for practical purposes, limited to about 5/16th inch across the flats. Machine screws using this tightening method are universally highly hardened, while the steel of a rifle barrel is comparatively quite soft and easily deformed. Over time, this method of attachment results in a barrel that becomes battered and disfigured in the area of the wrench engagement.

Other known methods of barrel attachment do not provide for repeatable installation and do not fully secure the barrels in the action, thus compromising accuracy. Such barrel attachment in certain cases has resulted in heavy or bulky components which compromise accuracy due to the inability of the barrel to be truly free floating and to vibrate at a natural resonant frequency when fired. The most accurate small arms in the world (known as "bench rest rifles") virtually all have free floating barrels. That is, there is no contact between the forearm and the barrel. A free floating barrel insures that barrel harmonics remain as uniform as possible from shot to shot and thereby eliminate any tendency of the forearm to transfer a variable external load to the barrel. Accordingly, a free floating barrel allows the barrel to vibrate at its natural resonant frequency. When the barrel is clamped or otherwise engaged so that its natural resonant frequency may be altered shot-to-shot, repeatable accuracy becomes impossible to achieve.

U.S. Pat. No. 1,517,328 addresses the foregoing problem by providing a design comprising a barrel within a barrel. The replacement barrel is secured to the primary barrel at the muzzle. However, there are both safety related and practical reasons why this design is not adaptable to modem large caliber, high pressure rifle loads. Modem high velocity rifle cartridges normally operate at pressures of up to 60,000 pounds per square inch and frequently generate muzzle energies of 3,000 foot pounds or more. For this reason, barrels must be very strong over the chamber section, and must be rigidly locked to the action/bolt assembly during firing. A barrel diameter over the chamber of at least 0.950 inches is generally considered minimal for such high velocity cartridges. Even this configuration has yielded ruinous barrel deformation with certain high pressure magnum loads. Since the replacement barrel under the attachment scheme of U.S. Pat. No. 1,517,328 must be inserted from the muzzle, the outside barrel or sleeve must be well over one inch in diameter for its entire length. This leads to an unaesthetic, bulky and grossly heavy firearm, totally unsatisfactory for many applications.

The conventional switch barrel apparatus disclosed in U.S. Pat. No. 1,517,328 also requires clearance between the inner and outer barrels. The stresses generated upon firing will cause the inner barrel to vibrate at its own resonant frequency and to be displaced in an unpredictable manner within the outer barrel. This further destroys reliable accuracy.

Even high quality steel is somewhat elastic. For this reason, firearm designers working with high intensity cartridges will condense the locking together of the bolt, action, and barrel in order to avoid excessive stretching during firing. Excessive stretching leads to a wide range of operational difficulties, including hard extraction, short cartridge case life and poor head space control. Most center fire rifles designed for high pressure cartridges accomplish the locking function within a span of two inches or less. However, the design of a switch barrel rifle applying the conventional technique of U.S. Pat. No. 1,517,328 would yield a locking span of approximately two feet, a totally undesirable and impractical configuration.

A further conventional method of providing a firearm with multiple interchangeable barrels is shown in U.S. Pat. No. 4,288,938. Barrel installation is accomplished through conventional threads on the firearm's frame and barrel, modified only slightly and secured by two set screws mounted perpendicular to the barrel's axis. However, recognizing that there must be clearance between the barrel threads and frame threads, such set screws when tightened act to thrust the barrel laterally within the frame, creating inconsistencies in a bullet's point of impact. The fact that U.S. Pat. No. 4,288,938 relies upon two set screws, each acting independently and in opposition to the other, means that there will be a large positional variation as to potential lock-ups, thus creating an unsatisfactory arrangement when accuracy is important. In addition, the arrangement shown in U.S. Pat. No. 4,288,938 deals exclusively with revolving cylinder type firearms.

U.S. Pat. No. 4,674,217 provides a reversible barrel concept wherein an underlug is machined or otherwise installed on both ends of the barrel to engage with a locating pin. This requires a separate manufacturing step which adds significantly to the complexity and thus the cost of producing a rifle barrel.

Also, since there must be a firing chamber at each end of the barrel, the barrel must have a heavy chamber section at each end. This disadvantageously produces an ungainly, bizarre appearing barrel profile and generates unacceptably high weight for certain applications. There is no feasible means for providing a reliable barrel crown. There is broad agreement among experts in firearm fabrication that, in order to provide a reliable crown, the profile of the crown must depart the line of the bore by an angle of at least 30° and up to 90°. The design of U.S. Pat. No. 4,674,217 necessarily uses a firing chamber throat as a crown. Virtually all throats are machined to an angle of 1.5° to 3.5° from the line of the bore, far too shallow to provide an accurate crown.

U.S. Pat. No. 3,138,889 provides another barrel within a barrel concept that is adaptable only to larger gauge shotguns. Very few shotguns currently in production are designed to withstand the pressures generated by high velocity rifle cartridges, thus effectively limiting the potential use of this conventional design to shot shells and low powered metallic ammunition. The conventional design of U.S. Pat. No. 3,138,889 is also only adapted to break-open firearms, which are not desirable from an accuracy standpoint.

U.S. Pat. No. 3,731,418 is another conventional system permitting barrel switching. It relies on a longitudinally slit receiver ring with a lateral clamping mechanism. As a consequence it requires its own unique receiver design which is not adaptable to other rifles.

All but one of the embodiments disclosed in U.S. Pat. No. 3,731,418 require that the action be removed from the stock in order to effectuate a barrel change. This is disadvantageous in that the process of removing the action becomes time consuming and offers greater potential for parts loss. A further embodiment relies on a lever within a separate forearm to provide the barrel clamping function, acting upon helical cams laterally mounted within the receiver ring. This adds weight, complexity and cost to the system. Moreover, a modest pull on the forearm would disengage the barrel clamp, producing a dangerous condition and destroying accuracy if the rifle is being fired at that moment.

U.S. Pat. No. 3,877,167 shows another conventional device for mounting barrels to actions and makes as a secondary claim the ability to quickly change barrels. However, this conventional technique requires a separate barrel extension be machined for each barrel. Such barrel extensions must be carefully machined and hardened and then correctly installed on their respective barrels, adding substantially to costs. This design also requires that the barrel reside within the barrel extension, which must in turn reside within the receiver. Thus, this design requires that the barrel must be smaller than a typical diameter, or that the receiver must be larger than is typical.

The conventional interchangeable barrel apparatus shown in U.S. Pat. No. 3,877,167 further requires a slip fit between the barrel extension and the receiver. Similarly, a slip fit also must exist between the threaded bushing and the barrel. Thus, the barrel may be secured in any number of slightly different positions within the action. As earlier noted, a shift of only 0.001 inch in the short span of a receiver ring can produce a point of impact of over 2 inches at 100 yards. Such a result is inconsistent with repeatable accuracy.

A further conventional method for interchanging barrels is the so-called Gamman Switch Barrel system. The Gamman system requires either a threaded adapter, which threads into the action to be used in lieu of the barrel, or a specially machined action. The barrel is then specifically machined to fit within this adapter. Both adapter and barrel require that large stop-collars be incorporated into each; these collars bear against each other where the barrel is properly attached to the action. A spring-loaded plunger mounted on the adapter parallel to the axis of the barrel engages a notch on the barrel's stop-collar. A threaded dust cover is then secured over the joined stop-collar. The Gamman scheme suffers from undue complexity and is unavoidably both bulky and heavy since it relies on the addition of a significant volume of metal to the existing barrel and action.

The additional weight added to the barrel and action makes the Gamman system disadvantageous for both lightweight sporting rifles and weight limited target rifles. The system is also fundamentally aesthetically unappealing. For example, a large lump of metal is added forward of the receiver ring, which destroys the normally sleek lines of a fine sporting rifle. A large notch must be cut out of the forearm to accommodate the stop-collar assembly, thereby yielding an unwelcome interruption of the stock's profile.

The aforementioned stock cut weakens the stock significantly in both the vertical and lateral planes. This increases both the risk of stock breakage and a tendency of the forearm to deflect under pressure. Another disadvantage of this system is its apparent inability to provide an adapter which reasonably fits within the action. Because the barrel threads must fit within the adapter, which must itself fit within the action, the barrel threads must be reduced in diameter to an unreasonably small size (approximately 0.750 inches). In contrast, virtually all centerfire rifles designed for cartridge heads of 0.473 and above have barrel threads of at least 0.980 inches in diameter, thereby providing a much greater margin of safety and resistance to unwelcome expansion when being fired.

Further, the Gamman system requires a comparatively large amount of high precision machining in order to achieve its operational objectives. This makes it very expensive in relative terms. For example, the price of a barrel conversion is presently quoted at approximately $1,365. For this sum it would be possible to purchase a good quality factory target rifle with optical sights as well as precision gunsmithing work. Therefore, this method is not cost effective.

Another conventional method for attaching different barrels to an action is the so-called Savage barrel nut method employed by Savage Manufacturing Company. This involves a barrel set-nut having the same interior threads as the receiver, which threads are used to lock the barrel and action together in the correct relationship. However, since this method uses the comparatively coarse barrel threads, it lacks the same degree of mechanical advantage possessed by the subject invention, and in practice, requires a high degree of torque in locking together the barrel and action. This produces an unwelcome degree of difficulty in disassembling the barrel and action, thereby rendering this method unsuitable for switch-barrel use. Additionally, such disassembly cannot take place with the action in the stock, due to the design of the locking barrel set nut. This fact makes the spanner/nut engagement subject to slippage during a barrel removal operation, and makes this method unsuitable for repeated barrel switching. The Savage, Inc. barrel nut method is merely an inexpensive way of quickly setting headspace on mass-produced actions and barrels. Thus, such an engagement system cannot accommodate the expedient switching of barrels of different calibers.

Another system for attaching a barrel to an action is embodied in U.S. Pat. No. 5,020,260. This is a system providing for a "take-down" rifle (one which may be readily broken in two and conveniently packed). However, it relies on an interrupted thread design, which disadvantageously weakens the action-to-barrel joint. Additionally, the barrel must be firmly attached to the stock fore-end, eliminating the possibility of a free-floating barrel. U.S. Pat. No. 5,020,260 has a tensioning nut, but it does not have the benefit of separate fine-pitch threads, relying instead on an extension of the standard barrel threads. Therefore, such a system lacks mechanical advantage. In addition, the tensioning nut bears against a barrel bracket rather than the action itself, which design limits the adjustment to less than 0.001 inch. U.S. Pat. No. 5,020,260 teaches a complex and comparatively costly system; if a user wished to have additional calibers for the same action, each barrel/forearm assembly is presently priced at $1,000.00. Thus, such a system requires either an expensive proprietary action, or extensive and costly modifications to a very limited range of commercially available actions.

In order to overcome the disadvantages and shortcomings of conventional switch barrel rifle systems, what is needed is a method and apparatus for securely locking a barrel to an action without deforming the barrel in any fashion and thus preserving barrel accuracy. Such a method and apparatus ideally would provide an invariant coaxial alignment of the action and barrel. That is, upon the removal and reinstallment of a given barrel, the rifle must automatically return to its target zero position.

What is needed is a convenient and speedy method and apparatus for barrel disassembly and interchangeability with barrels of different calibers without compromising weight as well as accuracy of the recipient firearm, and without the requirement for heavy or bulky tools, or complex and time-consuming procedures.

It also would be desirable to provide a switch barrel rifle capable of interchanging a plurality of barrels such that the barrels are kept in a completely free-floating mode in a manner similar to the majority of precision bench rest rifles. This advantageously would preserve accuracy of the highest order while permitting interchangeable barrels of different calibers to be used in the same firearm.

What is also needed is a fast and reliable method and apparatus for enabling interchangeable barrels to be employed with a wide variety of currently available actions and not require a complex, proprietary action.

What is also needed is a method and apparatus for securely holding the interchangeable barrels in the action, yet without deformation, such that accuracy is maintained.

It also would be desirable to provide a method and apparatus enabling the ready exchangeability of barrels without removing the action from the stock, (a necessarily time-consuming procedure which can increase the potential for parts loss).

What is also needed is an interchangeable barrel arrangement which retains the typical architecture of directly attaching the barrel to the action. This advantageously would aid in strength, compactness and lightness.

A method and apparatus enabling the ready interchangeability of barrels should accommodate free-floating barrels having a wide variety of possible weights and diameters. It also would be advantageous if the system could be readily adaptable to a variety of currently produced actions without requiring significant modification to those actions. It also would be desirable to provide a solid, repeatable lock-up of the barrel to the action such that the means for joining the barrel to the action would not come loose under heavy usage.

SUMMARY

In order to overcome the aforementioned disadvantages and shortcomings of a conventional interchangeable barrel system, an aspect of the invention provides an interchangeable barrel firearm wherein the exchange barrel attaches directly to the receiver by means of a V-threaded coaxial locking ring which acts to draw the barrel and receiver together toward a common, invariant center line. The locking ring threads on to the barrel using comparatively fine pitch threads and also bears against the receiver when secured. It will be appreciated that during each switch cycle of an interchangeable barrel, the locking ring will tend to draw the barrel and action together in coaxial alignment with a predetermined centerline. This provides an invariant direction of travel for the bullet to the target, thus enabling one to automatically reset the target zero position each time a barrel is removed and replaced.

The V-threads are provided on both the attachment thread of the barrel, receiver and locking ring. These threads are triangular in cross section and have the characteristics of a cone when assembled. This combination of threads advantageously acts to draw both the barrel and receiver to a repeatable center line during each barrel change cycle.

Another aspect of the invention enables one to change barrels with the action still in the stock, and therefore makes quick barrel interchangeability readily adaptable to wide variety of currently available actions.

A further aspect of the invention uses a spanner or wrench ten inches or more in length for conformably engaging the locking ring in a non-slip manner, rather than the barrel, in order to provide the necessary torque for securing the barrel to the receiver without deformation of the barrel. Advantageously, the torque required for locking is applied directly to locking surfaces of the locking ring rather than many inches down the barrel as in certain existing switch barrel systems. This also drives both the barrel and receiver toward a common centerline, while preventing deformation of the barrel.

DETAILED DESCRIPTION

An aspect of the invention provides a firearm having the ability to accept a wide variety of interchangeable barrels, which may be quickly, easily and reliably exchanged under field conditions. Another aspect of the invention provides a method and apparatus for interchanging barrels of different calibers in a manner so as to provide a substantially invariant coaxial alignment of the receiver and barrel due to the torque exerted by the locking ring which pulls the receiver and barrel toward a common center line. This provides the advantage of a repeatable target zero, even when interchanging barrels of different calibers.

Customarily, in the most accurate of small arms, the barrel is rigidly affixed to the receiver at the receiver ring by means of threads of medium pitch (that is, the threaded portion of the barrel is typically 0.980" to 1.10" in diameter, with a pitch of 1/13 to 1/20 of said diameter). Installation and removal of such barrels typically requires heavy, bulky equipment generally known as "action wrenches" and "barrel vises". A pair of these pieces of equipment easily can weigh 30 pounds or more, with the additional requirement that a barrel vise be firmly affixed to a rigid work bench or other such structure. Moreover, the firearm must be largely disassembled to accomplish this task. Thus, exchanging barrels outside a well-equipped shop is an impossibility, and rapid barrel exchanging, even with such equipment, equally impossible.

Figure 1:
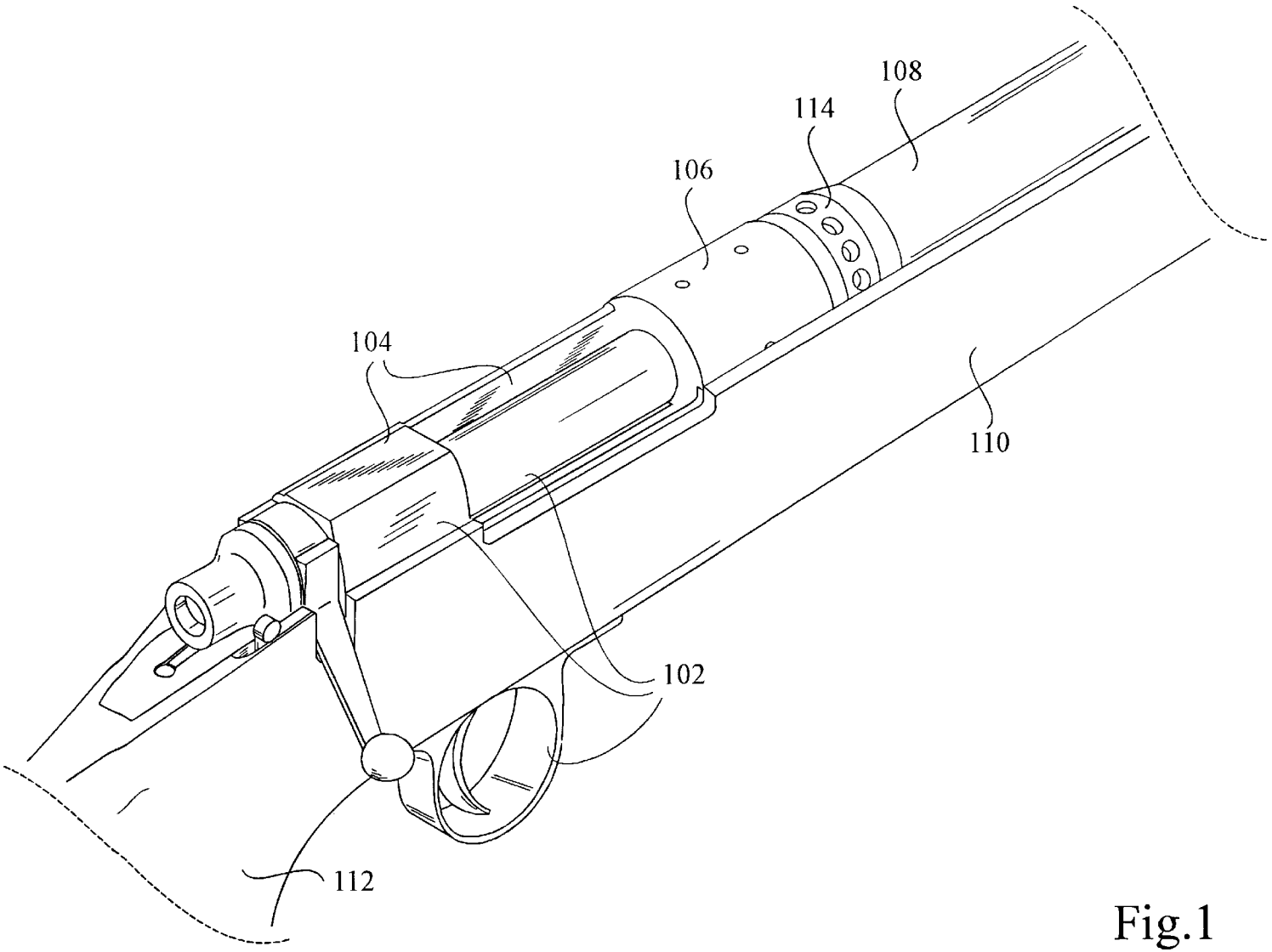
FIG. 1 shows a locking ring and interchangeable barrel installed on a conventional rifle in accordance with an aspect of the invention.

FIG. 1 shows rifle 100 incorporating the present invention rifle 100 comprises an action 102, a receiver 104 and attached barrel 108. The action 102 with attached barrel 108 are joined in the stock 112 which has as one of its components a forearm 110. The action 102 is also attached to stock 112 which may or may not be integrally incorporated with the forearm.

In accordance with an aspect of this invention, a cylindrical locking ring 114, internally threaded as shown, secures the barrel 108 to the receiver 104 at a threaded distal end of the receiver 104, known as the receiver ring 106 (shown internally).

Figure 2:
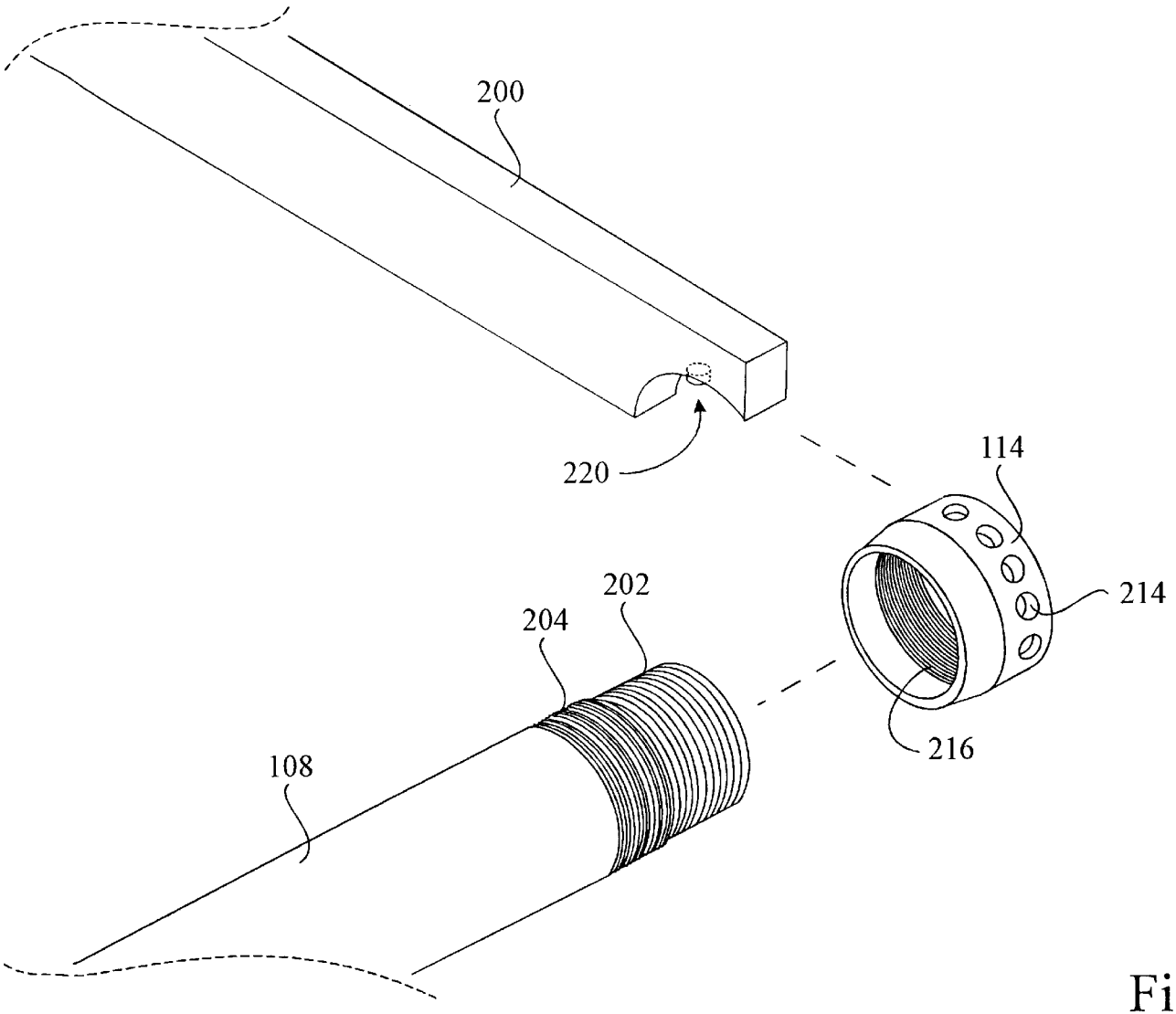
FIG. 2 shows the comparative engagement of a barrel, locking ring and spanner in accordance with an aspect of the invention.

As shown in FIG. 2 the locking ring 114 comprises basically a rotatable, cylindrical sleeve with coaxially aligned threads on the interior surface. The locking ring 114 comprises metal, carbon composite, polymer or other suitable material having a hardness of 25 or greater on the Rockwell C scale.

The interior surface of locking ring 114 comprises a series of fine pitch 60° "V" threads 216, which have a generally triangular cross-section. Corresponding threads for engaging with the locking ring threads are provided on the outer surface of the barrel. In accordance with an aspect of the invention, the V-shaped threads of the receiver ring 106 and locking ring 114 act as self-centering cones as they engage congruent threads in the receiver ring and the barrel threads. The substantially fine pitch locking ring threads provide a maximized mechanical advantage upon rotation of the locking ring. The mechanical advantage of the locking ring threads acts to sufficiently bind the receiver and barrel in substantially invariant coaxial alignment without the requirement for excessive torque during tightening. This provides the advantage of repeatable accuracy in firing with any given barrel.

The conical aspect of the V-threads of the locking ring are designed to be coaxially self-centering with respect to the receiver and barrel. That is, the locking ring threads, when engaging the complimentary threads of the barrel and receiver, draw both the receiver and barrel together in coaxial alignment along a common center line. This advantageously results in a strong coaxial locking alignment between the barrel and receiver due to the torque which can be exerted by the spanner 200, when engaging the locking ring. It will be appreciated that the spanner engages only the locking ring and thus protects the barrel and its threads from deformation and imprecise alignment.

The substantially invariant coaxial alignment of receiver, locking ring and barrel results in a substantially repeatable target zero within a given barrel.

Figure 3:
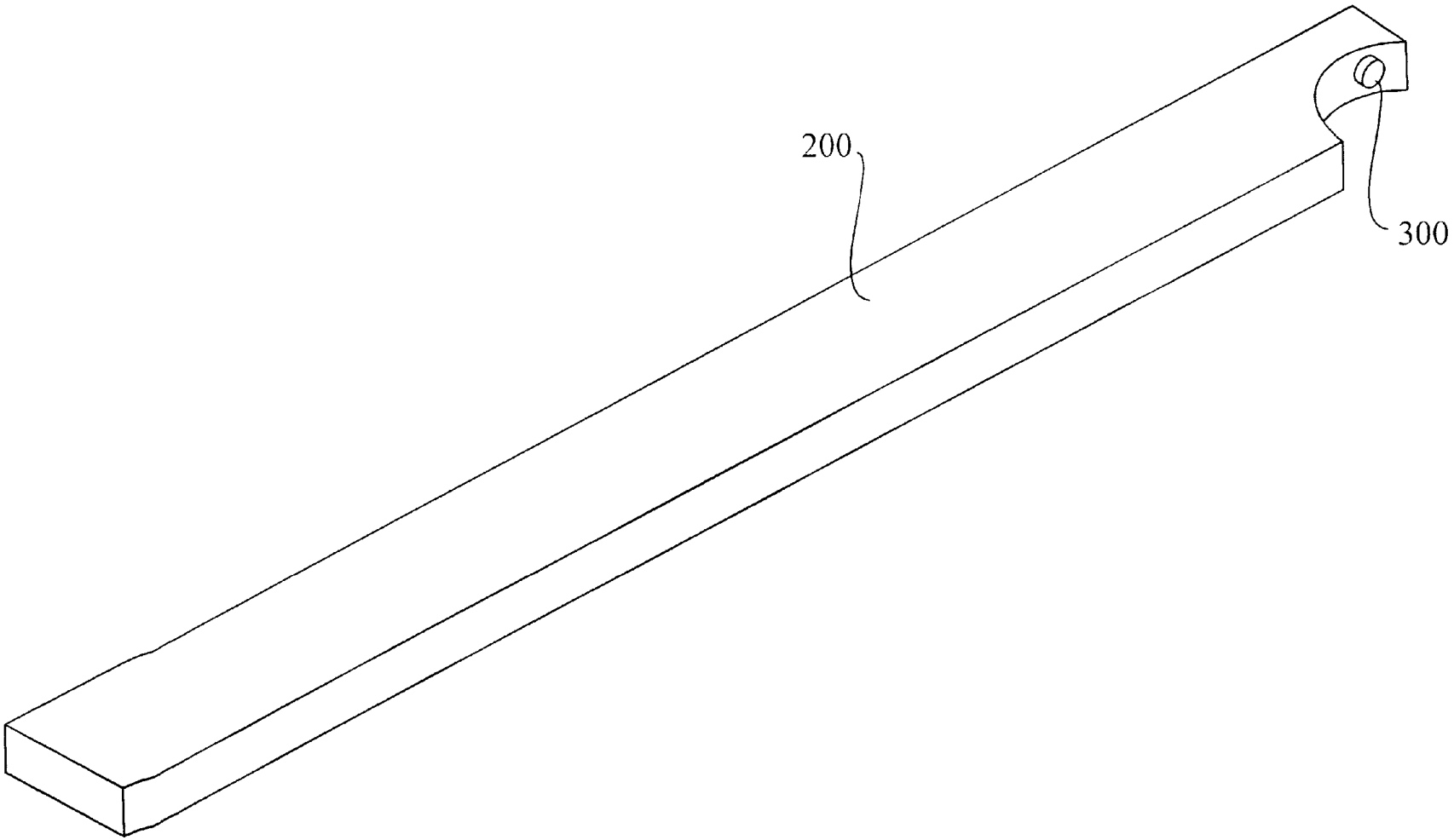
FIG. 3 shows a spanner for fitting the locking ring in accordance with an aspect of the invention.

It will be appreciated that the foregoing aspects of the invention permit the ready exchangeability of barrels with the spanner 200 shown in FIGS. 2 and 3. Particular advantages and aspects of the invention are summarized as follows:

1. The ability to readily switch barrels without removing the action from the stock.
2. To provide a solid, repeatable lockup of the barrel to the action such that the joint will not come loose under use, and to assure that, upon the removal and reinstallment of a given barrel, the rifle will return to zero.
3. To be able to accomplish the barrel switching operation under field conditions without heavy, complex or bulky equipment.
4. To assure that the system was adaptable to standard stock configurations without significant cuts in the stock or complicated stock modifications.
5. To assure that the system would permit a barrel shank diameter immediately forward of the action of at least 1.10", thus providing a safe and rigid chamber section for use with high intensity cartridges having head diameters of up to 0.582".
6. To assure that the system would accommodate free floating barrels having a wide variety of possible weights and diameters.
7. That the system be readily adaptable to a variety of currently-produced actions, without significant modification to said actions.
8. That the system lend itself to production and delivery at a moderate cost.

In order to permit a secure engagement of the locking ring 114 to the barrel 108 and receiver 104 without excessive torque, a thread pitch substantially finer than available barrel threads is necessary. A plausible range of screw pitches is 28 to 36 threads per inch. 28TPI was selected for initial use. This fine pitch increases the available mechanical advantage of the threads, permitting a rigid lock-up of receiver to barrel with the application of much less torque than typically used with the traditional method of attachment.

With reference to the barrel 108 shown in FIG. 2, the secondary threads 204 must be larger in diameter than the primary barrel threads 202 in order for the locking ring 114 to pass over the primary barrel threads 202 from the front, and in order to permit a barrel shank chamber section (not shown) of at least 1.10". However, the secondary threads 204 must not be overly large in this dimension or the locking ring diameter will exceed the receiver ring diameter, leading to an unusual and unsightly appearance. A locking ring thread diameter of 1.125" was selected for initial use, with a locking ring outside diameter of 1.305", which dimensions can be modified to suit individual requirements.

In order for a barrel to be removed without removing the action from the stock, the spanner 200 must be able to engage the locking ring 114 in any position it may occupy, and rotate with it for a limited distance. Accordingly, the locking ring 114 is provided with multiple lug recesses 214, and the spanner 200 is designed to permit operation as described above, with an arc of engagement of approximately 120°.

For the spanner to provide reliable, slip-free engagement with and rotation of the locking ring 114, fore-and-aft movement must be essentially eliminated, and a close fit with the locking ring surface must be maintained. The spanner lug 300 and corresponding locking ring lug recesses 214 must have bearing surfaces near 90° to the locking ring tangent. Thus, the locking ring lug recesses 214 are cylindrical, and the spanner 200 and spanner lug 300 are carefully machined to correspond to the locking ring. Also, the spanner 200 is provided with a locking ring engaging portion 220 which conformably fits around the locking ring 114 to aid in the slip-free application of torque to the locking ring.

In manufacturing, the barrel of the firearm in question is first turned to a diameter larger than primary (regular) barrel threads 202, immediately forward of said primary threads 202. This diameter will be approximately 0.250" smaller than the width of the firearm's action proximate to the barrel. Fine-pitched threads 204 are then machined on this turned portion of the barrel, to accept a correspondingly threaded locking ring 114, which has an outside diameter similar to or slightly smaller than the width of the proximate portion of the receiver. This locking ring 114 has a substantial number of lug recesses 214, arranged circumferentially around the ring, the walls of which recesses are at or near 90° to the tangent of the ring. These recesses are typically cylindrical in form and 0.060" to 0.080" deep, but may also vary in depth somewhat and be of any convenient polygonal shape. A spanner 200 with a hardened lug 300 corresponding to the lug recesses 214 is fabricated. This spanner is used to tighten the locking ring 114 against the receiver once the barrel has been screwed into the receiver to the correct depth, thus firmly securing the barrel and receiver together.

A variety of methods exist to correctly govern the depth of the barrel in the receiver to thereby ensure a correct headspace for barrels of different calibers. Among such methods are: use of headspace gauges or similar spacers during assembly, the gauges being inserted in the barrel chamber as the barrel is screwed into place; a pin or shoulder being screwed or otherwise placed inside the receiver ring to block the rearward travel of the barrel threads at the point of correct spacing; a witness mark or marks on the barrel which align properly at the point of correct spacing; and carefully regulating the length of the barrel's primary threaded portion such that the barrel ceases to advance further into the action at the point of correct spacing.

A general description of the barrel changing operation using the foregoing aspects of the invention is as follows:

1. The telescopic sight (if any) is removed.
2. The supplied spanner is properly engaged with the locking ring, and rotated in the unlocking direction, removing tension between the barrel and receiver.
3. The barrel is then unscrewed by hand, and lifted clear of the stock.
4. A properly fitted replacement barrel with locking ring attached is then screwed into the receiver. A "go" headspace gauge (or similar spacer) is inserted in the chamber, the bolt placed in locked position, and the barrel tightened by hand until snug. The alternate methods of insuring correct barrel installation (and thus correct headspace) are checked.
5. The locking ring is then rotated into contact with the receiver, and tightened under moderate torque to lock barrel and receiver together.
6. The headspace is then verified using a "no-go" headspace gauge, and the telescopic sight reattached.

It will be appreciated that the foregoing aspects of the invention provide a true switch barrel rifle capable of accommodating barrels of different caliber, which easily can be interchanged in the field. Due to the substantially invariant coaxial alignment of the barrel with the receiver provided by the invention, any given barrel is capable of firing essentially to the same point of impact following the removal and replacement of such barrel.

While the invention has been described in connection with what is presently considered to be the most practical and preferred embodiments, it is to be understood that the invention is not limited to the disclosed embodiments, but on the contrary it is intended to cover various modifications and equivalent arrangements included within the spirit and scope of the appended claims. For example, the locking ring may be lengthened in the case of heavier barrels and may comprise a differently shaped exterior surface or differing lug recesses for coaxially locking the barrel to the action. However, in such a configuration the present invention still provides the advantage of automatically repositioning both the barrel and receiver in coaxial alignment to a common centerline and therefore reliable repeatability of the target zero position. Therefore, persons of ordinary skill in this field are to understand that all such equivalent arrangements and modifications are to be included within the scope of the following claims.

What is claimed is:

1. A firearm system for readily interchanging barrels capable of repeatable accuracy upon removal and installation of a given barrel comprising:

One or more barrels having an outer surface and an interior surface defining a bore aligned along a central axis, said one or more barrels each having a receiver end for attaching to a firearm receiver, said receiver end characterized by at least one set of large diameter, fine pitch threads provided for threadable engagement on the outer surface of the barrel;

a locking ring comprising an outer surface and an interior surface aligned along a central axis, and comprising a set of threads disposed on the interior surface for threadably engaging the fine pitch barrel threads, said locking ring further provided with a series of lug recesses disposed substantially circumferentially about the outer surface for engagement with a spanner comprising a lug end configured for conformably engaging a lug recess and said outer surface of said locking ring such that rotation of the spanner moves the locking ring to draw both the barrel bore and receiver into repeatable coaxial alignment following removal and replacement of said one or more barrels.

2. A system for interchanging a plurality of barrels on a firearm and for enabling firing to essentially the same point of impact following removal and replacement of said barrels comprising:

a rifle barrel having a bore aligned along a central axis, and a threaded end comprising at least one set of threads characterized by large diameter and fine pitch;

a locking ring having an outer surface provided with multiple lug recesses and an interior surface provided with a plurality of substantially fine pitch threads characterized by a triangular cross section for threadably engaging the threads of the rifle barrel;

a receiver having threads on an inner surface thereof for threadably engaging the primary barrel threads.

3. A system as in claim 2 wherein said set of threads of the rifle barrel are provided with a thread pitch in a range of substantially 1/27 to 1/40 the diameter of the threaded end of said barrel.

4. A system according to claim 2 wherein the locking ring threads are characterized by a thread pitch substantially finer than the primary threads of the rifle barrel and characterized by a pitch in a range of about 28 to 36 threads per inch.

5. A system according to claim 2 wherein said rifle barrel comprises a first series of primary (original) barrel threads and a series of secondary barrel threads adjacent to said primary threads such that said secondary threads are larger in diameter than the primary barrel threads to enable the locking ring to pass over the primary barrel threads and to provide a barrel shank chamber section of at least 1.10 inches.

6. A system according to claim 2 further comprising a spanner for conformable engagement with said lug recesses and outer surface of said locking ring to provide reliable, slip-free rotation of said locking ring.

7. A firearm having interchangeable barrels capable of firing to essentially the same point of impact following removal and replacement of said barrels comprising:

a plurality of barrels, each barrel defining a bore having a central axis, and an end for attaching to a firearm receiver said end of the barrel provided with a plurality of V-threads on the exterior surface thereof;

a locking ring comprising an exterior surface provided with a plurality of lug recesses, and an interior surface provided with a plurality of fine pitch threads of substantially triangular cross section for engagement with said V-threads of the barrel such that rotation of the locking ring draws both the barrel and receiver to a repeatable center line along said central axis during each barrel change cycle.

8. A firearm having interchangeable barrels in accordance with claim 7 further including a spanner comprising a lug end for conformably engaging the locking ring in a non-slip manner to secure the barrel to the receiver without deformation of the barrel.

* * * * *